US005383671A

United States Patent [19]

Teets et al.

[11] Patent Number: 5,383,671

[45] Date of Patent: Jan. 24, 1995

[54] ANCHORING SYSTEM FOR A THREE DIMENSIONAL ANIMAL TARGET

[76] Inventors: David A. Teets, R.D. 1 Box 116 Rte. 68, Rochester, Pa. 15074; Joseph D. Salvador, Jr., 119 Crescent Dr., New Galilee, Pa. 16141

[21] Appl. No.: 181,011

[22] Filed: Jan. 14, 1994

[51] Int. Cl.[6] ..... F41J 3/00

[52] U.S. Cl. ..... 273/407

[58] Field of Search ..... 273/403, 404, 406, 407, 273/408, 409, 410

[56] References Cited

U.S. PATENT DOCUMENTS

| | | | |
|---|---|---|---|
| 2,048,155 | 7/1936 | Armantrout | 273/407 |
| 3,163,418 | 12/1964 | Myers | 273/408 |
| 3,413,003 | 11/1968 | Bell | 273/408 |
| 4,477,082 | 10/1984 | McKenzie et al. | 273/403 |

*Primary Examiner*—William H. Grieb

*Attorney, Agent, or Firm*—A. C. Addessi

[57] ABSTRACT

An anchoring system for a three dimensional animal target includes a means for attaching the anchoring system to the three dimensional animal target. The means for attaching may include a pipe, a shaft or stabilization member, at least one screw, or combinations thereof. The anchoring system also includes a first member or metal plate for providing a step for a person to apply force to the anchoring system during the mounting of the three dimensional animal target. A second member or metal shaft is attached to the first member and is inserted into the ground or other supporting surface as force is applied to the first member during mounting of the animal target. The anchoring system may additionally include a stabilization member or metal shaft attached to the first member for providing an additional member which is inserted into the ground during mounting of the animal target.

21 Claims, 2 Drawing Sheets

ANCHORING SYSTEM FOR A THREE DIMENSIONAL ANIMAL TARGET

BACKGROUND OF THE INVENTION

This invention relates to a three dimensional animal target and, more particularly, to an anchoring system for mounting the three dimensional animal target in the ground.

Three dimensional animal targets may be constructed of foam to simulate the form of an animal, such as a deer, bear, elk, or moose. These targets are used by hunters who practice shooting into the targets. To simulate actual hunting conditions, it is advantageous to move the target to various positions for shooting practice.

Currently, several types of three dimensional targets have a conduit-rebar anchoring system. This anchoring system includes target supports, such as a first pipe or conduit which extends from a front portion of the animal target and a second pipe or conduit which extends from a rear portion of the animal target. To mount the target in the ground, two rods or rebars are pushed into the ground in positions which align with the pipes extending from the animal target. Then, the conduits attached to the target are slid onto the rebars. However, this anchoring system requires precise alignment of the conduit and the rebar of the front and rear portions of the animal target simultaneously, requiring an expenditure of time in mounting and remounting the animal target for various shooting positions.

Additionally, the first and second conduits are not always parallel making the alignment of the conduit and rebar more difficult.

Another type of three dimensional animal target includes target supports, such as a first rod which extends from a front portion of the animal target and a second rod which extends from a rear portion of the animal target. An anchoring system includes a pipe which may be slid onto the rod, a first member for applying force to the animal target, and a second member for insertion into the ground. However, the utilization of this anchoring system onto the three dimensional animal target having conduits, instead of rods, as the target supports provides a support which may be unstable for the three dimensional animal target.

Therefore, what is needed is an anchoring system which may be quickly and easily positioned and repositioned for changing the location of the three dimensional target and which provides a stable support for the three dimensional animal target.

SUMMARY OF THE INVENTION

An anchoring system of a three dimensional animal target comprises means for attaching the anchoring system to the three dimensional animal target. The anchoring system also includes a first member attached to the means for attaching in a manner so that pressure may be applied to the first member during anchoring of the three dimensional animal target. A second member is attached to the first member and positioned extending in an opposite direction from the first member as the means for attaching extends from the first member for insertion of the second member into a supporting surface. A means for stabilizing is attached to at least one of the first and second members for providing additional support to the three dimensional target.

An advantage of the anchoring system is that the three dimensional animal target may be quickly positioned and repositioned. The first member provides a step for a person to step on or hammer, to insert the anchoring system into the ground while the anchoring system is attached to the three dimensional target.

Another advantage is that all of the members of the anchoring system are attached to the three dimensional target adding to the efficient and convenient mounting of the three dimensional target for shooting practice.

The utilization of at least one stabilizing member provides an additional advantage of supporting the three dimensional target while the target is mounted into the ground or other supporting surface.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus for anchoring a three dimensional animal target into the ground.

Figure 1:
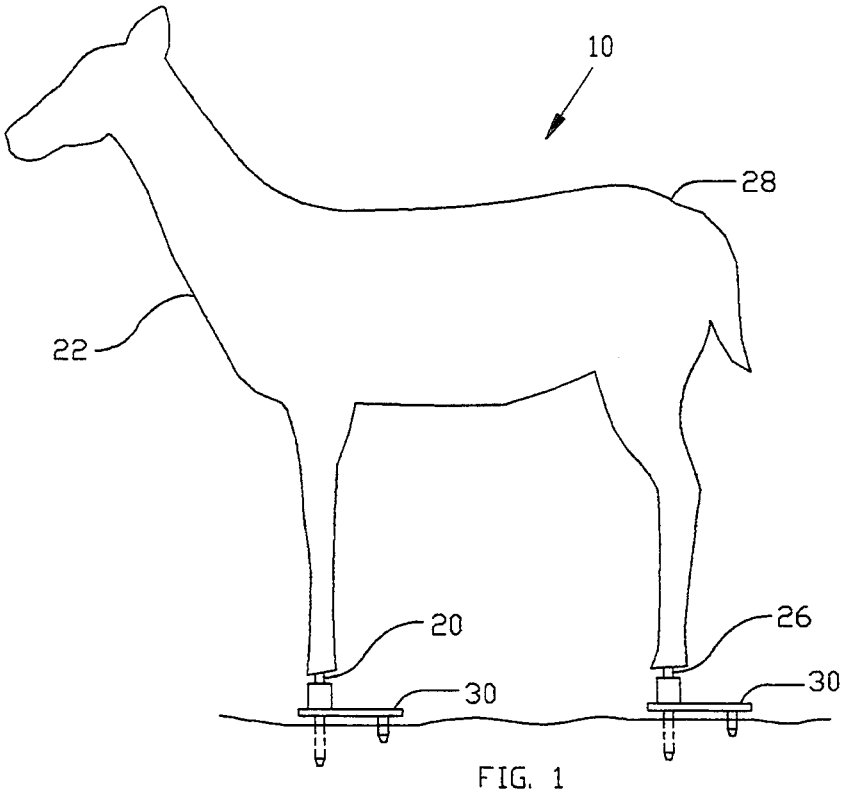
FIG. 1 is a perspective view of a three dimensional animal target.

Referring to FIG. 1, a three dimensional animal target 10 is shown mounted to the ground. The three dimensional animal target 10 illustrates a deer target, however, the three dimensional animal target 10 may be any animal used to practice shooting, such as a bear, elk, moose, or the like. The three dimensional animal target 10 has a first pipe 20 or conduit attached to and extending from a front portion 22 of the three dimensional animal target simulating a forward portion of an animal. A second pipe 26 or conduit is attached to and extends from a rear or opposite portion 28 of the three dimensional animal target 10 simulating a rearward portion of an animal.

Figure 2:
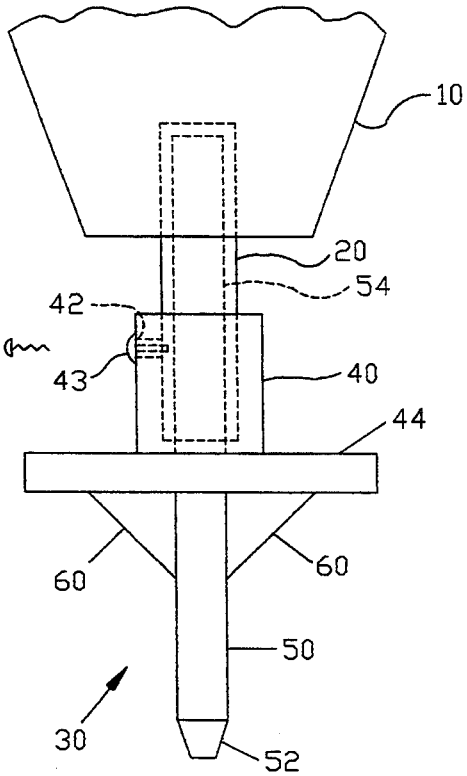
FIG. 2 is a view of an anchoring system attached to the three dimensional animal target.

Referring to FIGS. 1 and 2, an anchoring system 30 is attached to the first pipe 20 and to the second pipe 26 of the three dimensional animal target 10. The anchoring system 30 includes means for attaching the anchoring system 30 to the three dimensional animal target 10. The means for attaching includes a pipe 40 sized to be slid onto the pipes 20 and 26 of the animal target 10. The inside diameter of the pipe 40 may vary for accommodating the various sizes of conduits 20 and 26 protruding from the different types of three dimensional animal targets. The pipe 40 has at least one hole 42.

The means for attaching also may include a screw 43, such as a self-tapping screw, a pin, a nut and bolt, or the like, positioned within at least one hole 42 of the pipe 40 for securing together the anchoring system 30 and the three dimensional animal target 10.

The anchoring system 30 also includes a first member 44, for example, a metal plate, a shaft, or the like, which is attached, such as by welding, to the pipe 40. Preferably, the first member 44 is attached to an end of the pipe 40, at least partially enclosing one end of the pipe 40 for enabling the pipes 20 and 26, after being slid onto pipe 40 of the anchoring system 30, to seat against the first member 44 for support of the three dimensional animal target 10. Alternatively, the first member 44 is attached to a side of the pipe 40.

The first member 44 is positioned substantially perpendicular to the ends of the pipe 40 for positioning the first member 44 substantially parallel to the ground during mounting of the three dimensional animal target 10. The positioning of the first member 44 with respect to the means for attaching or pipe 40 provides at least one step or means for applying force to the three dimensional animal target 10 during mounting of the target 10 into the ground or other supporting surface. This step enables a person to apply pressure to the anchoring system 30 to mount the three dimensional animal target 10.

The anchoring system 30 also includes a second member 50, for example, a metal shaft or the like, attached to the first member 44, such as by welding. The second member 50 is attached to the first member 44 substantially perpendicularly or in a manner so that the second member 50 extends from the first member 44 in a direction substantially opposite to the extension of the pipe 40 from the first member 44, for enabling attachment of the pipe 40 to the three dimensional target 10 and insertion of the second member 50 into the ground, thereby mounting the animal target 10 in an upright or standing position for shooting practice. To facilitate insertion of the anchoring system 30 into the ground, the second member 50 has a tapered portion 52 positioned at one end of the second member 50.

The anchoring system 30 also includes a means for stabilizing or a first stabilizing member 54, for example a metal shaft or the like, attached to the first member 44, such as by welding. The first stabilizing member 54 is positioned within the pipe 40 and extends within the pipes 20 and 26 of the three dimensional animal target 10 for providing support and stabilization of the three dimensional animal target 10 after installation of the anchoring system 30 onto the three dimensional target 10. The length of the first stabilizing member 54 may be longer than the length of the pipe 40 so that the first stabilizing member 54 extends beyond an end of the pipe 40 after assembly of the anchoring system for providing additional support.

Figure 6:
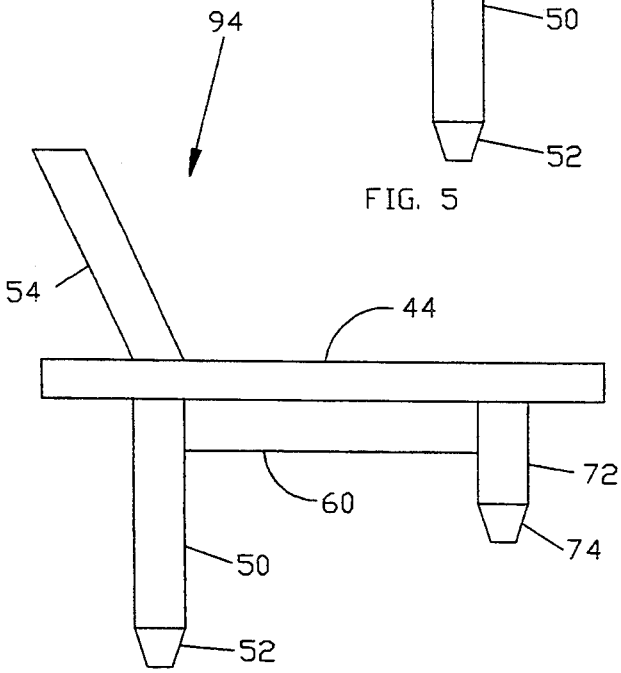
FIG. 6 is a view of an alternative embodiment of the anchoring system of FIG. 5 having the stabilizing member.

Referring to FIGS. 1, 2 and 6, the first stabilizing member 54 is positioned substantially perpendicular to the first member 44. Alternatively, the first stabilizing member 54 and the pipe 40 may be positioned at an angle from the first member 44 for installation of the anchoring system 30 onto a target support which may extend at an angle from the three dimensional animal target 10, compared to pipe 20 which extends substantially perpendicular to the animal target 10, for maintaining the position of the first member 44 as substantially parallel to the ground during mounting of the three dimensional animal target 10.

A support member 60, for example, a metal plate or the like, may be attached, such as by welding, to the first and second members 44 and 50. The support member 60 is positioned adjacent to the first and second member 44 and 50 for bracing the members of the anchoring system 30.

To install the anchoring system 30 onto the three dimensional animal target 10, the first stabilizing member 54 is inserted into each of the pipes 20 and 26 of the animal target 10. The pipes 20 and 26 seat within the pipe 40 against the first member 44. Preferably, the hole 42 of the pipe 40 is positioned so that after attachment of the anchoring system 30 to the three dimensional animal target 10, the first member 44 protrudes approximately perpendicular to the body of the animal, for providing a step or means for applying force to insert the second member 50 into the ground. To allow for quick repositioning of the target 10, the anchoring system 30 is attached to the three dimensional animal target 10, for example, by inserting the screw 43 into at least one hole 42 of the pipe 40 and engaging the pipes 20 and 26 of the target 10.

To set up the three dimensional animal target 10 for shooting practice, a person steps on the first member 44, alternating between the anchoring system 30 of the front portion 22 and of the rear portion 28 of the three dimensional animal target 10. The three dimensional animal target 10 is in position for shooting practice, simulating an animal standing in an upright position.

For the various embodiments of this invention, the same reference characters will be used to designate like parts. In addition, like functions and like interaction of the parts among the various embodiments of this invention will not be repeated for each embodiment.

Figure 3:
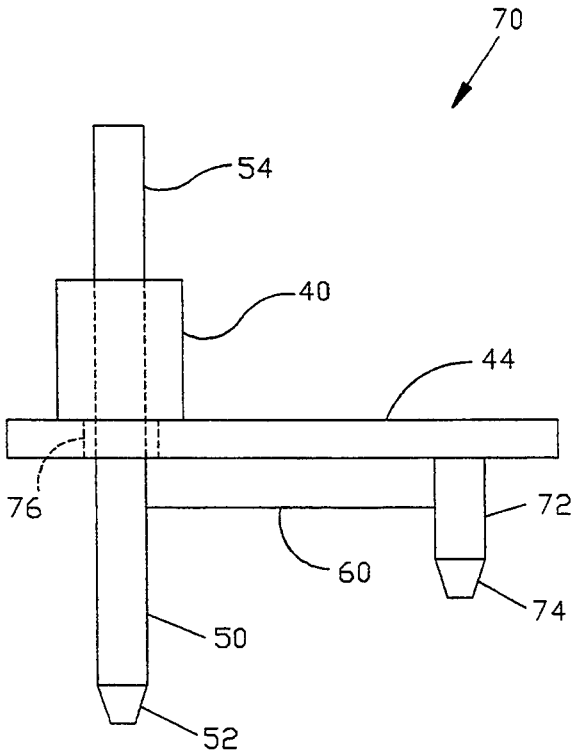
FIG. 3 is a view of an alternative embodiment of the anchoring system of FIG. 2 having a stabilizing member.

Referring to FIGS. 2 and 3 and using the same reference characters to define like parts, an alternative embodiment of the anchoring system 30 may be anchoring system 70 having like parts as the anchoring system 30 and additionally having a means for stabilizing or a second stabilizing member 72. The second stabilizing member 72, for example, a metal shaft or the like, is attached, such as by welding, to the first member 44 for providing an additional member which may be inserted into the ground for support of the three dimensional animal target 10. The second stabilizing member 72 may be attached substantially parallel to the second member 50, extending from the first member 50 on an opposite side of the first member 44 as the means for attaching, and spaced a distance from the second member 50. To facilitate insertion into the ground, the second stabilizing member 72 has a tapered portion 74.

The first stabilizing member 54 may be integrally formed with the second member 50, as illustrated in FIG. 3, or the second member 50 and the first stabilizing member 54 may be separate members, as illustrated in FIG. 2. Utilization of separate members enables the positioning of the second member 50 either aligned with the first stabilizing member 54 or offset from the first stabilizing member 54. Referring again to FIG. 3, the first stabilizing member 54 and the second member 50 are positioned within an aperture 76 of the first member 44.

Figure 4:
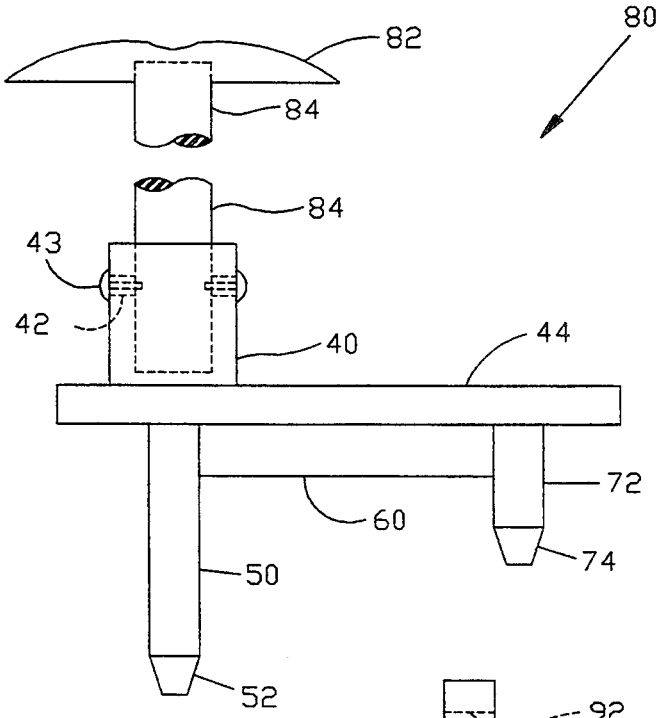
FIG. 4 is a view of an alternative embodiment of the anchoring system of FIG. 3 without having a stabilizing member extend through a pipe, enabling attachment of the anchoring system to a three dimensional animal target having a rod as the target support.

Referring to FIGS. 3 and 4 and using the same reference characters to define like parts, an alternative embodiment of the anchoring system 70 may be anchoring system 80 having like parts as the anchoring system 70 without having the first stabilizing member 54 extend through the pipe 40. The absence of the first stabilizing member 54 protruding through the pipe 40 enables the anchoring system 80 to be installed onto a type of three dimensional animal target 82 utilizing a rod 84, such as a solid wood shaft, instead of conduits 20 and 26 extending from the front and rear portions of the animal target as the target supports.

Figure 5:
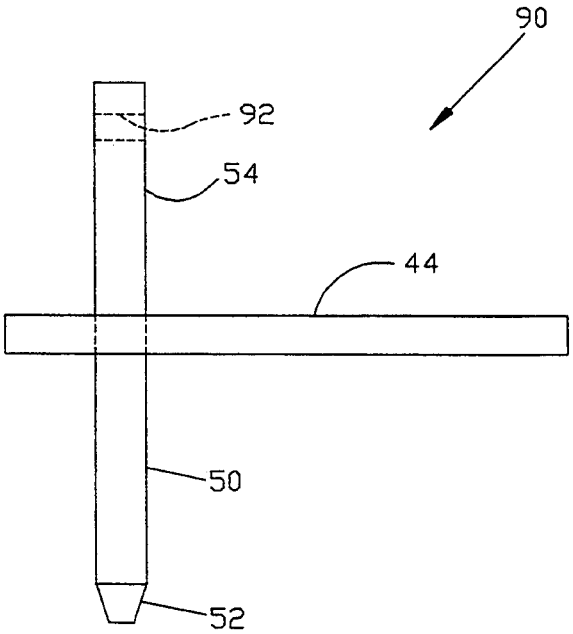
FIG. 5 is a view of an alternative embodiment of the anchoring system of FIG. 2 without having the pipe.

Referring to FIGS. 2 and 5 and using the same reference characters to define like parts, an alternative embodiment of the anchoring system 30 may be anchoring system 90 having like parts as the anchoring system 30 without having the pipe 40. The anchoring system 90 may be molded into the foam of the three dimensional animal target during manufacture of the three dimensional animal target in substitution for, for example, the conduit or pipes 20 and 26 of the three dimensional animal target 10. For this embodiment, the means for attaching, such as a metal shaft or the like, may include the means for stabilizing.

Alternatively, the first stabilizing member 54 has at least one hole 92. To install the anchoring system 90 onto the three dimensional animal target 10, the first stabilizing member 54 is slid into the pipes 20 and 26. The hole 92 of the first stabilizing member 54 is aligned with a hole of the pipes 20 and 26, and means for attaching, such as a bolt is inserted into the aligned holes and secured with a nut.

Referring to FIGS. 3, 5 and 6 and using the same reference characters to define like parts, an alternative embodiment of the anchoring system 90 of FIG. 5 may be anchoring system 94 having like parts as the anchoring system 90 and additionally having the second stabilizing member 72 as illustrated in FIG. 3. The second stabilizing member 72 provides additional support for the three dimensional animal target 10 during shooting practice. The anchoring system 94 may be molded into the foam of the animal target during manufacture of the animal target, for example, the means for attaching may include the means for stabilizing. Alternatively, the anchoring system 94 may be attached, for example, by a screw or nut and bolt, to the three dimensional animal target.

The utilization of the anchoring systems 30, 70, 80, 90 and 94 enable the three dimensional animal targets 10 and 82 to be quickly anchored to the ground. The three dimensional animal targets 10 and 82 may be positioned and repositioned easily and efficiently by stepping on, hammering, or the like, the first member 44 or step of the anchoring system 30, 70, 80, 90 or 94.

Therefore, the anchoring system provides quick anchoring of the three dimensional animal target and provides support for the three dimensional animal target when the three dimensional animal target is in position for shooting practice.

We claim:

1. An anchoring system of a three dimensional animal target, comprising:

means for attaching the anchoring system to the three dimensional animal target;

a first member attached to the means for attaching in a manner so that pressure may be applied to the first member during anchoring of the three dimensional animal target;

a second member attached to the first member and positioned extending from the first member in a direction which is substantially opposite to a direction the means for attaching extends from the first member for insertion of the second member into a supporting surface; and means for stabilizing the anchoring system attached to at least one of the first and second members and positioned extending from the first member for insertion into at least one of the supporting surface and the three dimensional animal target.

2. The anchoring system according to claim 1 wherein the means for stabilizing extends from the first member in a direction which is substantially opposite to a direction the second member extends from the first member for insertion of the means for stabilizing into the three dimensional animal target.

3. The anchoring system according to claim 1 wherein the second member is integrally formed with at least one of the means for stabilizing and the means for attaching.

4. The anchoring system according to claim 1 wherein the means for stabilizing is attached to the first member a distance from the second member and extends from the first member in a direction which is substantially opposite to a direction the means for attaching extends from the first member for insertion of the means for stabilizing into the supporting surface.

5. The anchoring system according to claim 1 wherein the means for attaching includes a pipe attached to the first member.

6. The anchoring system according to claim 5 wherein the pipe has at least one hole.

7. The anchoring system according to claim 5 wherein the means for stabilizing is positioned within the pipe attached to the first member.

8. The anchoring system according to claim 1, further comprising at least one support member positioned adjacent to and attached to the first and second members.

9. The anchoring system according to claim 1 wherein the means for attaching is molded into the three dimensional animal target during manufacture of the three dimensional animal target for securing together the anchoring system and the three dimensional animal target.

10. The anchoring system according to claim 1, the three dimensional animal target having a target support, wherein the means for attaching comprises at least one screw positioned within a hole of at least one of the means for attaching and the target support and engaging the other of the means for attaching and the target support for securing together the anchoring system and the three dimensional animal target.

11. An anchoring system of a three dimensional animal target, comprising:

means for attaching the anchoring system to the three dimensional animal target;

a first member attached to the means for attaching for providing a step onto which a person may apply pressure during anchoring of the three dimensional animal target;

a second member attached to the first member and positioned extending from the first member in a direction which is substantially opposite to a direction the means for attaching extends from the first member for insertion of the second member into a supporting surface; and means for stabilizing the anchoring system attached to the first member a distance from the second member and extending from the first member in a direction which is substantially opposite to a direction the means for attaching extends from the first member for insertion of the means for stabilizing into the supporting surface.

12. The anchoring system according to claim 11 wherein the means for attaching includes a pipe attached to the first member.

13. The anchoring system according to claim 11 wherein the first and second members are positioned approximately perpendicular to each other.

14. The anchoring system according to claim 11 wherein the stabilizing member extends at an angle other than perpendicular to the first member for insertion of the stabilizing member into various types of three dimensional animal targets.

15. The anchoring system according to claim 11, further comprising at least one support member positioned adjacent to and attached to the first and second members.

16. An anchoring system of a three dimensional animal target, having at least one target support comprising:

a first member for applying force to the three dimensional animal target during anchoring of the three dimensional animal target;

a second member attached to the first member and positioned in a manner so that an application of force to the first member inserts the second member into the ground;

a pipe, attached to the first member, sized to slide onto the target support for connection of the pipe to the target support of the three dimensional animal target;

a first stabilizing member positioned within the pipe and extending from the first member in a direction substantially opposite to a direction the second member extends from the first member for insertion of the first stabilizing member into the target support of the three dimensional animal target; and a second stabilizing member attached to the first member and extending in a direction substantially similar to a direction the second member extends from the first member so that an application of force to the first member inserts the second stabilizing member into the ground.

17. The anchoring system according to claim 16 wherein the first stabilizing member is molded into the three dimensional animal target during manufacture of the three dimensional animal target for securing together the anchoring system and the three dimensional animal target.

18. The anchoring system according to claim 16, further comprising:

the first member having an aperture; and the first stabilizing member, integrally formed with the second member, extending through the aperture of the first member and through the pipe.

19. The anchoring system according to claim 16, further comprising at least one support member positioned adjacent to and attached to the first and second members.

20. The anchoring system according to claim 16, further comprising:

the pipe having at least one hole; and a screw positioned in each hole and engaging the target support of the three dimensional animal target for securing together the anchoring system and the three dimensional animal target.

21. An anchoring system of a three dimensional animal target, comprising:

means for attaching the anchoring system to the three dimensional animal target;

a first member attached to the means for attaching in a manner so that pressure may be applied to the first member during anchoring of the three dimensional animal target;

a second member attached to the first member and positioned extending from the first member in a direction which is substantially opposite to a direction the means for attaching extends from the first member for insertion of the second member into a supporting surface; and means for stabilizing the anchoring system attached to at least one of the first and second members and extending from the first member in a direction which is substantially opposite to a direction the second member extends from the first member for insertion of the means for stabilizing into the three dimensional animal target.

* * * * *